United States Patent [19]

Gabster

[11] Patent Number: 4,770,086

[45] Date of Patent: Sep. 13, 1988

[54] PORTABLE VENTILATION SAFETY DEVICE

[76] Inventor: Jeffrey C. Gabster, 151 Dolores Circle, Apt. 3, Indiana, Pa. 15701

[21] Appl. No.: 87,512

[22] Filed: Aug. 20, 1987

[51] Int. Cl.[4] ..... F24F 7/00

[52] U.S. Cl. ..... 98/50; 160/350; 160/351; 160/377

[58] Field of Search ..... 98/50; 160/330, 350, 160/351, 372, 357, 376, 377; 299/12

[56] References Cited

U.S. PATENT DOCUMENTS

| | | | |
|---|---|---|---|
| 1,180,124 | 4/1916 | Foedisch | 160/377 |
| 2,186,510 | 1/1940 | Walter et al. | 160/377 X |
| 2,621,725 | 12/1952 | Shacikoski | 160/350 X |
| 3,118,363 | 1/1964 | Burgess, Jr. | 98/50 |
| 4,139,101 | 2/1979 | Towfigh | 160/351 X |
| 4,282,802 | 8/1981 | Divers et al. | 98/50 |
| 4,708,189 | 11/1987 | Ward | 160/351 |

FOREIGN PATENT DOCUMENTS

| | | | |
|---|---|---|---|
| 569993 | 6/1945 | United Kingdom | 160/377 |

*Primary Examiner*—Harold Joyce

*Attorney, Agent, or Firm*—Berman, Aisenberg & Platt

[57] ABSTRACT

Ventilation safety apparatus for extending toward a mine face from a supported area includes a collapsible frame supported on the mine floor, the supports for the frame being connected by a beam, and arms extending upwardly when in released position to support a brattice curtain extending from floor to roof of the mine passage. The arms are foldable to lie substantially parallel to the connecting beam for transporting the apparatus. The device is pushed outward beyond the fixed brattice curtain to extend the workable area ahead of the supported mine roof.

16 Claims, 1 Drawing Sheet

PORTABLE VENTILATION SAFETY DEVICE

FIELD OF THE INVENTION

The invention relates to a remotely installed ventilation curtain useful in underground mines for providing air control near a mine working face.

BACKGROUND OF THE INVENTION

Different types of line brattices have been used to seal, control and direct the flow of air in underground mines. Those of particular relevance to the present invention are of the extensible curtain type in which at least a portion of the line curtain is advanced toward the mine working face as a material cutting machine advances beyond the last roof bolt of the supported roof.

In mining coal underground, the room and pillar method of mining is often used in which a main gallery has a plurality of rooms or side galleries branching out laterally from the main gallery, separated by pillars. Each pillar is an expanse of rock left unmined in order to prevent subsidence. A mining machine makes a series of cuts into the face of a short wall of a room, as a result of which the room gradually becomes longer.

As material, for example coal, is mined, dust and gases are liberated at the face which, if left to accumulate, could build up to form explosive or otherwise harmful concentrations. Accordingly, ventilation systems have been devised in which escaping gases and/or dust cannot build up but are removed by air channels. In practice, each room is divided by a longitudinal line curtain or brattice which extends from the main gallery to a point near the face, and from the floor to the roof. Typically, the brattice curtain is made of a fire-proofed canvas which is fastened to a batten bolted to the roof and/or fastened to posts. The curtain hangs to the floor where the excess is weighted down with rocks. Typically, the brattice is placed off-center, toward one side of the room. The mining machine is in the wider portion and fans direct a pattern of air circulation carrying dust from the face through the narrower portion provided by division of the room by the brattice curtain. In order to maintain this flow, the brattice curtain must have its leading edge near to but spaced away from the face.

Government regulations require workers to stay away from the face being mined until after the mine roof has been bolted by a cage-protected roof bolting machine operator. The problem to be solved is the manner of extending the brattice curtain, at least temporarily, without any person going into the area where the new section of curtain is to be installed.

Known methods of accomplishing this objective are not entirely satisfactory. Burgess, U.S. Pat. No. 3,715,969 shows a mine ventilation control system including an extensible curtain assembly which is mounted on a header member at mine roof level adjacent the end of a fixed brattice curtain and advanced toward the working face of the mine at a rate commensurate with the removal of the rate of material being mined. Divers, U.S. Pat. No. 4,282,802, shows a slideboard with an attached brattice cloth which acts as an extension of a line brattice. The slideboard is advanced toward the working face of the mine to provide an inlet passage for clean air and an outlet passage for dust-laden air as the mining machine advances. The top of the brattice cloth is supported on half-hoop hoses, providing a flexible seal with the roof of the mine shaft.

The patent to Baker, U.S. Pat. No. 4,440,070, describes a section of brattice mounted on a cart having retractable wheels. The brattice has a frame which permits the curtain section to be extended and retracted vertically for adjustment of height, allowing engagement with the mine roof. The device is spring mounted to enable the top of the curtain to conform to unevenness in the level of the mine roof. The device is bulky and cumbersome in use.

Divers, U.S. Pat. No. 4,494,894, shows a mobile support system for a brattice curtain. The floor engaging member may either be skid plates, wheels, or a conventional roof jack. The curtain depends from an upper support beam which is cantilevered from upwardly extending beams extending from a fulcrum adjacent the floor engaging member. The patent to Hill, U.S. Pat. No. 4,607,507, describes an extensible line brattice including a track system, brattice frame, and a curtain mounted on the track system for extension into an unprotected portion of a mine passage. The track system is engaged midway between the upper and lower edges of the curtain, and the curtain is extended over a frame which terminates at its upper edge adjacent the roof, and at its lower edge adjacent the floor, of the mine shaft.

None of the patents described above shows a readily portable collapsible frame for a brattice curtain which may easily be carried into the mine and pushed out from under the bolted section of a passageway toward the mine face and then extended into working position.

SUMMARY OF THE INVENTION

A portable ventilation safety device for extending toward a mine face from a supported area includes a collapsible frame which rests on the mine floor and a brattice curtain attached to the frame. Foldable spring-loaded arms extend upward from each end of the device, for supporting a brattice curtain. The arms are pivotable to lie substantially folded adjacent the frame when in folded position and to stand upright substantially adjacent the mine roof when in extended position. The device is foldable for carrying into and out of the mine and for sliding out into the mine passage from the bolted area toward the face. The device may be moved forward according to movement of the mining machine.

It is an object of the invention to provide an improved ventilation safety device for use in mines.

It is a further the object of the invention to provide a portable, folding brattice curtain carriage for use in mines.

DETAILED DESCRIPTION OF THE INVENTION

Figures 1, 2:
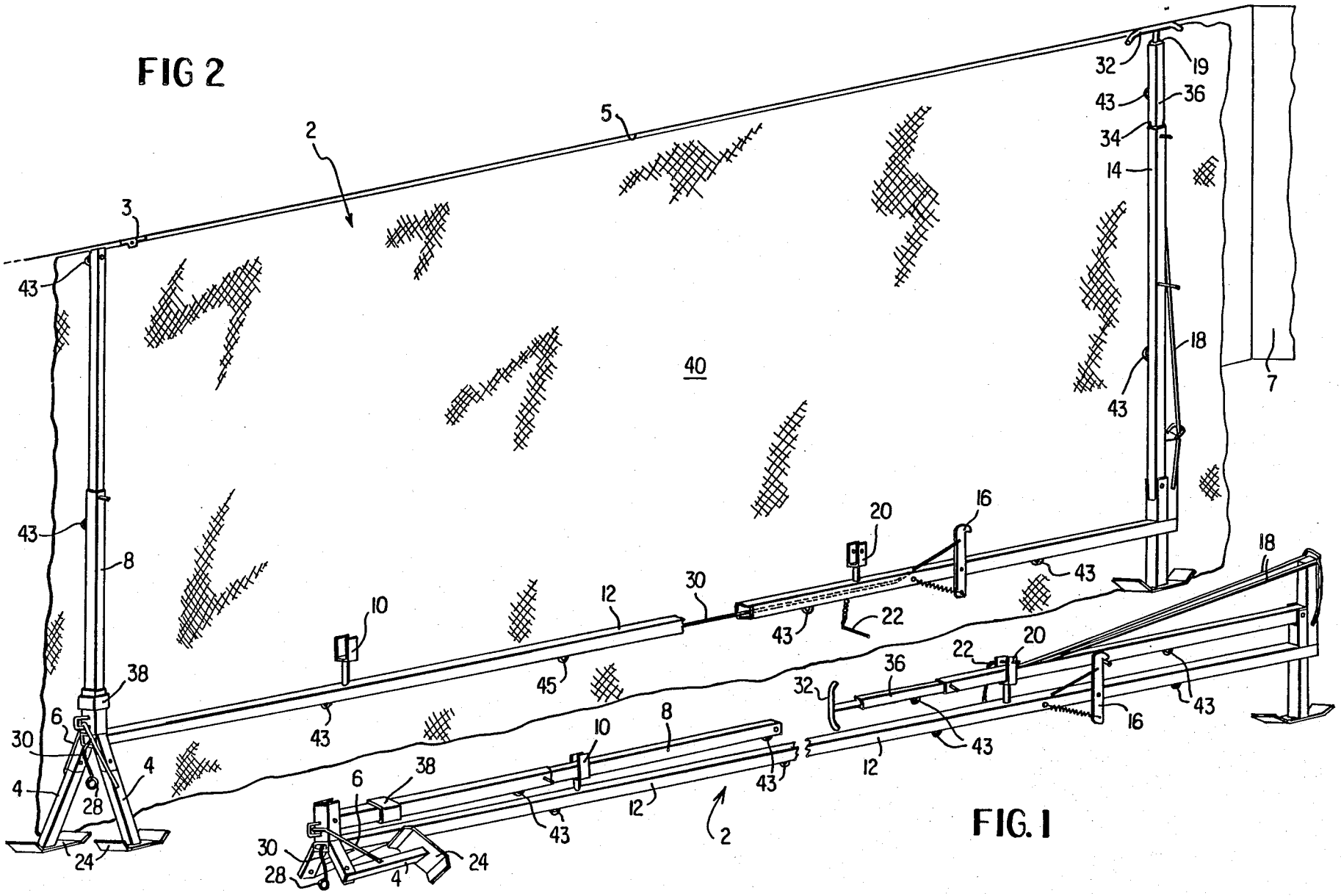
FIG. 1 is a perspective view of the apparatus in folded position, without an attached curtain.
FIG. 2 is a perspective view of the apparatus in extended position, with an attached curtain.

When continuous mining machines are employed to cut coal from a working face, the law requires that the depth cut into the coal face not be greater than ten feet from the forward end of the brattice or line curtain. In order to comply with this requirement, either the mine roof behind the machine must be continuously bolted to keep up with the mining machine, or the area which has not yet been bolted must be able to be ventilated in advance of the bolting machine by use of a portable line curtain. In practice, continuous bolting is not possible, and the machine operator must often hold up production for a half hour or more until the roof is bolted.

The portable apparatus of this invention, to which a brattice cloth is attached, folds for easy transportation and may readily be pushed ahead of the bolted section, by a miner standing under the bolted section, and then unfolded and extended to provide a line curtain to within ten feet of the face being mined. Use of the apparatus of the invention allows work to continue ahead of the bolted section without the necessity for frequently stopping work to wait for the roof to be bolted.

With reference to the Figures in which like numerals represent like parts, FIG. 1 shows apparatus 2 in folded position as it is pushed out beyond the outermost roof bolt 3 of the supported roof in the mine passage, but without a curtain attached. FIG. 2 shows apparatus 2 in extended position as used in a mine passage. The roof 5 of the passage toward mining face 7, ahead of bolt 3 is unsupported. Device 2 is light in weight and easily transported. In use, a brattice curtain 40 (not shown in FIG. 1, for clarity) is attached to the apparatus before it is pushed into the unsupported passage for extension into its working position. The device 2 is pushed parallel to the fixed canvas brattice curtain 9 supported by the last roof bolt 3, and outward therefrom along the length of the passage. The operator remains behind the last roof bolt 3 of the supported roof, as required by government regulations. When the operator pushes the device forward, device 2 has rear legs 4 folded up and held in place by an elastic cord or spring 6. Rear arm 8 is folded down adjacent the frame and held in place by a support 10 on main beam 12. Front arm 14 is folded down adjacent the frame and held in place by latch 16, on beam 12 stretching elastic cords or springs 18. The top end 19 of front arm 14 is held in support 20 and safety pin 22 is engaged to prevent accidental release of arm 14. Device 2, having an attached brattice curtain 40, is pushed forward toward the face dividing the mine passage into a wider passage on one side for the mining machine and a narrower passage on the other side for fan-forced return of dust-laden ventilating air.

When device 2 has been moved into position, rear legs 4 are dropped into position and held in place by elastic cord or spring 6. Rear legs 4 preferably have skids 24 at their lower ends for facilitating movement along the mine floor. Safety pin 22 is removed from its position securing front arm 14 in support 20 and the operator, positioned away from the face, behind the last row of permanent roof supports 3, pushes device 2 as far as necessary toward the face 7 being mined. When device 2 is in the proper position, parallel to the longitudinal walls of the passage, the operator pulls ring 28 which is connected to wire 30 which runs along beam 12. Wire 30 is attached to latch 16 on beam 12, and pulling on ring 28 releases the latch, and spring-loaded arm 14 swings up into vertical position releasing at least a portion of the tension on springs 18. Spring-loaded roof skid 32, engaged in top end 19 of arm 14, automatically extends until it engages the roof. Roof skid 32 is preferably made of brass to prevent sparking when it touches or scrapes along the roof. Roof skid 32 is spring-loaded vertically to compensate for irregularities in the roof. Rear arm 8, under the supported roof, is then raised manually and locking collar 38 is positioned to lock rear arm 8 in extended position, for use.

Front arm 14 and rear arm 8 are each optionally made having at least one telescoping section, such as section 36 shown extended from front arm 14, and section 37 shown extended from rear arm 8, in FIG. 2, for adjusting the height of the arms according to the height of the mine roof. Rear arm 8 may also optionally include a roof skid similar to roof skid 32, shown engaged with front arm 14. Alternative arrangements of arms are within the scope of the invention providing that the arms are foldable and extendable to provide a collapsible frame for the portable device.

Before pushing the apparatus out into the passage, brattice curtain 40 is secured to the apparatus, ready for deployment, so that when front arm 14 is raised, front edge of brattice curtain 40 is likewise raised. Curtain 40 is attached to the apparatus in any conventional manner, such as by connecting grommets on the edge of curtain 40 to washers 43, attached to the beams, by means of nylon ties (not shown). The washers may, for example, be ½ inch steel washers welded about 20 inches apart on the beams. Raising rear arm 8 raises curtain 40 and pulls it tightly into position. A length of curtain is left free at the rear end of the apparatus and this is attached to the existing fixed ventilation brattice 9 to provide a continuous length of curtain extending down the mine passage. The curtain extends close to the mine roof at the top and hangs down to the floor beneath the apparatus, to effectively divide the passage for the purpose of channeling ventilating air flow.

The length of the apparatus is approximately twelve feet, but may be varied according to use. For deeper cuts, a longer brattice curtain attached to an additional member which is stored in, and telescopes out from, the main beam may be used. This allows the device to reach twenty feet or further into the unsupported mine passage. The apparatus may be made of steel members to provide structural strength, and the folding arms may be made of steel or of aluminum alloy for lightness, or aluminum or other lightweight but strong materials may be used for the entire apparatus. The apparatus as described weighs about 38 lbs. without the curtain. The curtain is made of fire-proofed canvas, plastic or other material known in the art and approved by mine health and safety authorities, and may weigh as little as about 2 lbs. or less. The main beam 12 may be 1½ inch square thinwall steel tubing, and the front and rear arms may have ¾ inch square tubing telescoping into 1 inch square tubing arms. The main beam and front and rear arms may alternatively be of fiberglass, plastic, or other suitable material known in the art.

As a radio-operated continuous mining machine advances into the working face, apparatus 2 is pushed further along the mine floor by an operator standing under the supported roof. This permits the forward edge of the device to be kept within ten feet of the working face, as required by government regulations, until overlap of the length of the apparatus with the fixed curtain supported by the permanent roof support has been exhausted.

While the invention has been described above with respect to certain embodiments thereof, it will be appreciated that variations and modification may be made without departing from the spirit and scope of the invention.

What is claimed is:

1. A portable, collapsible ventilation device for extending longitudinally along a mine passage having a roof and a floor toward a mine face from a supported area into an unsupported area comprising:

frame means for being easily transported;

a pair of spaced apart arm means for receiving means for dividing the mine passage, each of said arm means connected to the frame means and pivotable to lie substantially adjacent the frame means in folded position and to stand substantially upright in extended position, whereby the means for dividing the mine passage comprises means for attaching along each of said arm means and said dividing means extends between said upstanding spaced apart arm means and substantially between the mine roof and the mine floor when the arm means are in extended position, one of said spaced apart extended arm means being positioned under the supported area and the other said extended arm means being positioned longitudinally along the mine passage toward the mine face.

2. A device of claim 1 wherein the arm means extend substantially adjacent a mine roof portion in extended position.

3. A device of claim 1 further comprising means for dividing the mine passage.

4. A device of claim 3 wherein the means for dividing the mine passage comprises curtain means.

5. A device of claim 1 wherein the frame means comprises supporting means for resting on the mine floor.

6. A device of claim 5 wherein the supporting means comprises skid means for contacting the mine floor.

7. A device of claim 1 wherein the frame means comprises elongated means for connecting arm means.

8. A device of claim 7 wherein the frame means further comprises means for increasing the length of the device.

9. A device of claim 1 further comprising spring means for holding at least one of the arm means in position.

10. A device of claim 5 further comprising spring means for holding at least one of the supporting means in position.

11. A device of claim 1 further comprising latch means for releasably fastening at least one of said arm means to the frame means.

12. A device of claim 11 further comprising remote means for releasing said latch means.

13. A device of claim 1 wherein the arm means further comprises means for extending the arm means toward a mine roof portion.

14. A device of claim 1 further comprising at least one roof skid means engaged with said arm means for contacting the mine roof.

15. A device of claim 14 wherein the at least one roof skid means is spring-loaded for contacting the mine roof.

16. A device of claim 15 wherein the at least one roof skid means comprises brass material.

* * * * *